US009581970B2

(12) United States Patent
McLoughlin

(10) Patent No.: US 9,581,970 B2
(45) Date of Patent: Feb. 28, 2017

(54) SLEEVE KEEPER WATCH BRACKET

(71) Applicant: John E. McLoughlin, Hauppauge, NY (US)

(72) Inventor: John E. McLoughlin, Hauppauge, NY (US)

( * ) Notice: Subject to any disclaimer, the term of this patent is extended or adjusted under 35 U.S.C. 154(b) by 11 days.

(21) Appl. No.: 14/138,248

(22) Filed: Dec. 23, 2013

(65) Prior Publication Data

US 2015/0177693 A1 Jun. 25, 2015

(51) Int. Cl.
*G04B 47/00* (2006.01)

(52) U.S. Cl.
CPC ..... *G04B 47/00* (2013.01)

(58) Field of Classification Search
CPC ..... G04B 37/00
USPC ..... D10/1, 30, 32; D11/3
See application file for complete search history.

(56) References Cited

U.S. PATENT DOCUMENTS

| | | | | | |
|---|---|---|---|---|---|
| 2,000,923 | A * | 5/1935 | Colbiornsen | 24/15 | |
| 2,509,428 | A * | 5/1950 | Greene | 224/670 | |
| 3,462,809 | A * | 8/1969 | Froehlich, Jr. | 24/562 | |
| 3,584,455 | A * | 6/1971 | Sion | G04B 43/00 | 368/283 |
| 3,962,758 | A * | 6/1976 | Knappe et al. | 24/562 | |
| 4,353,124 | A * | 10/1982 | Weinzettel et al. | 368/258 | |
| 5,467,324 | A * | 11/1995 | Houlihan | G04B 47/025 | 368/10 |
| 5,546,641 | A * | 8/1996 | Radvin et al. | 24/557 | |
| 6,366,538 | B1 * | 4/2002 | Anderson et al. | 368/10 | |
| 6,480,441 | B1 * | 11/2002 | McKay | 368/10 | |
| 6,799,887 | B1 * | 10/2004 | Kinney | 368/282 | |
| 7,380,287 | B2 | 6/2008 | DeSantis | | |
| 2011/0173782 | A1 * | 7/2011 | English | 24/532 | |
| 2011/0290829 | A1 * | 12/2011 | Watrach | 223/37 | |
| 2015/0112168 | A1 * | 4/2015 | Conrad et al. | 600/309 | |

FOREIGN PATENT DOCUMENTS

| | | | |
|---|---|---|---|
| EP | 1074190 | A2 | 7/2001 |
| EP | 1143310 | A2 | 10/2001 |
| WO | WO2011086349 | A1 | 7/2011 |

* cited by examiner

*Primary Examiner* — Amy Cohen Johnson
*Assistant Examiner* — Jason Collins
(74) *Attorney, Agent, or Firm* — Wei Wei Jeang; Grable Martin Fulton PLLC

(57) ABSTRACT

A sleeve keeper watch bracket for use with a wristwatch worn by a user, comprises a first member having a shape and size generally corresponding to a case of the wristwatch, the first member generally lying in a first plane, a second member generally lying in a second plane parallel to and above the first plane, a third member coupling the first member and second member, and wherein the first member is affixed to the wristwatch case and the second member extends away from the user's hand and is adapted to hold back a long sleeve of a garment worn by the user.

13 Claims, 5 Drawing Sheets

SLEEVE KEEPER WATCH BRACKET

FIELD

This disclosure relates to accessories, and is related in particular to a sleeve keeper watch bracket.

BACKGROUND

Many of today's garments worn by both men and women feature long sleeves that reach the wearer's wrist, such as dress shirts, blouses, suit jackets, windbreakers, dress coats, rain coats, tunics, hoodies, etc. When wearing these long-sleeve garments, the wearer must push back the sleeve when he/she raises his/her arm to reveal the wristwatch. Therefore, reading time becomes a two-handed operation that maybe impractical or inconvenient at times, such as when the wearer is carrying packages, an umbrella, a purse, a suitcase, etc., or operating machinery.

DETAILED DESCRIPTION

Figure 1:
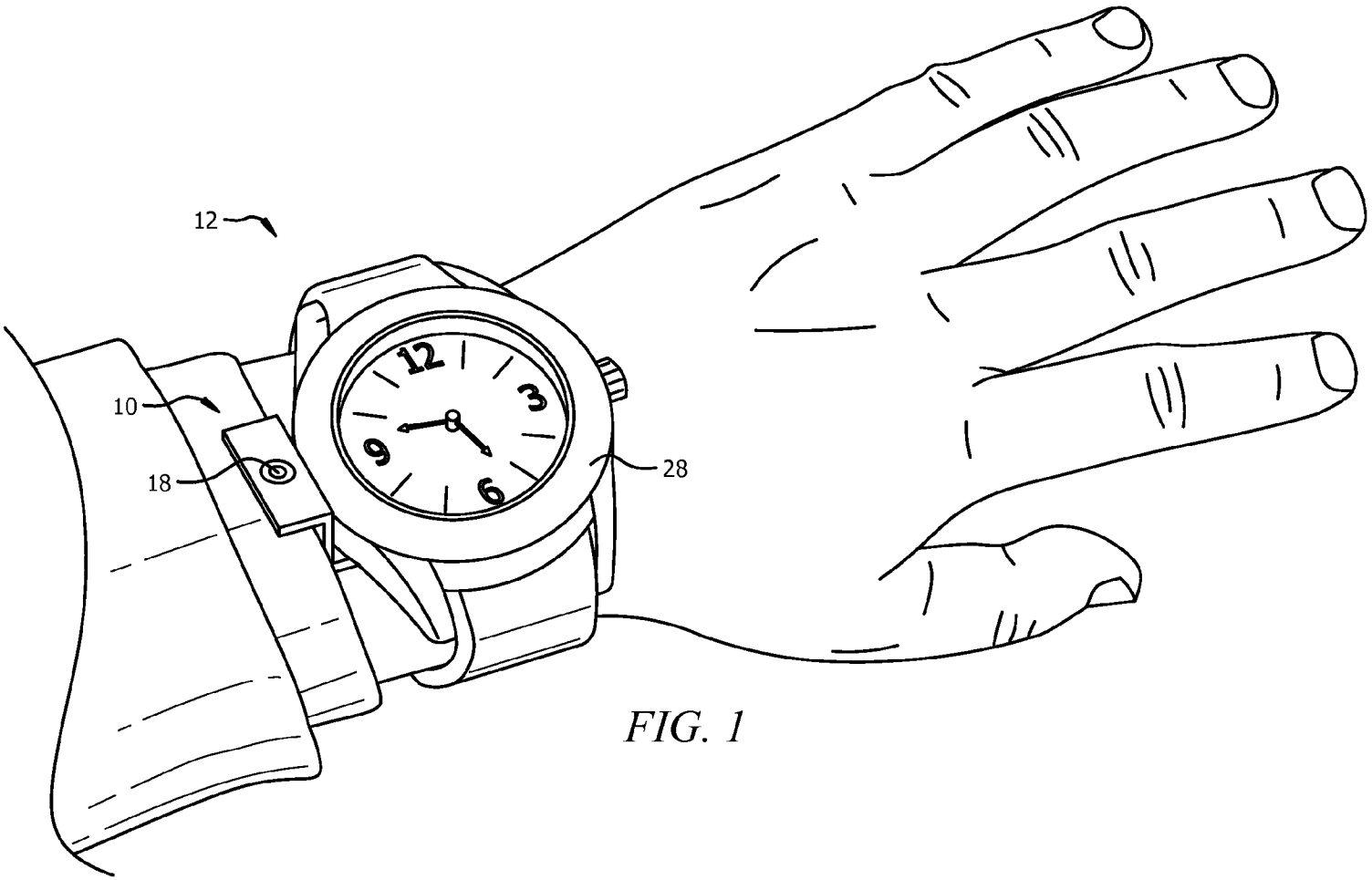
FIG. 1 is a perspective view of an exemplary embodiment of a sleeve keeper watch bracket in use with a wristwatch according to the teachings of the present disclosure.
Figure 2:
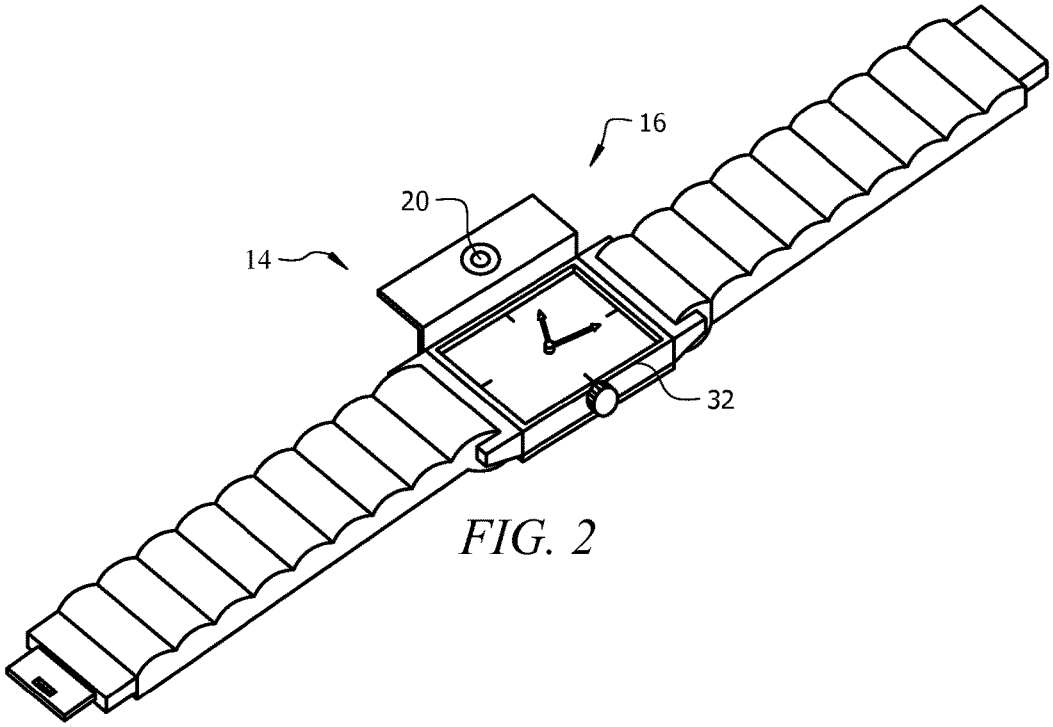
FIG. 2 is another perspective view of an exemplary embodiment of a sleeve keeper watch bracket in use with a wristwatch according to the teachings of the present disclosure.
Figure 3:
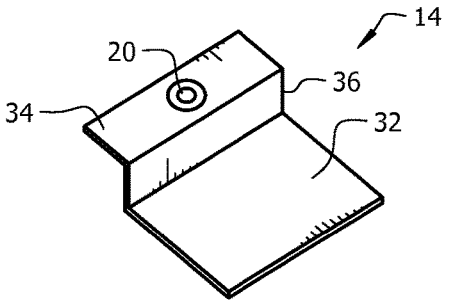
FIG. 3 is a perspective view of an exemplary embodiment of a sleeve keeper watch bracket according to the teachings of the present disclosure.
Figure 4:
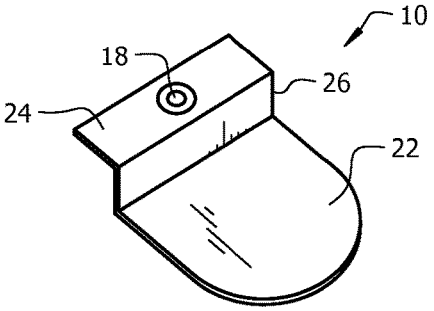
FIG. 4 is a perspective view of another exemplary embodiment of a sleeve keeper watch bracket according to the teachings of the present disclosure.

FIG. 1 is a perspective view of an exemplary embodiment of a sleeve keeper watch bracket 10 in use with a round-faced wristwatch 12 according to the teachings of the present disclosure. The sleeve keeper watch bracket 10 can be a component that a user can add onto an existing wristwatch 12, or wristwatch 12 can be made with the bracket 10 integrally built-in. FIG. 2 is a perspective view of an exemplary embodiment of a sleeve keeper watch bracket 14 in use with a square-faced wristwatch 16 according to the teachings of the present disclosure. Both sleeve keeper watch brackets 10 and 14 incorporate a lighting element 18 and 20 that may be decorative or functional in nature. FIGS. 3 and 4 are perspective views of the sleeve keeper watch bracket 10 and 12 according to the teachings of the present disclosure.

Figure 5:
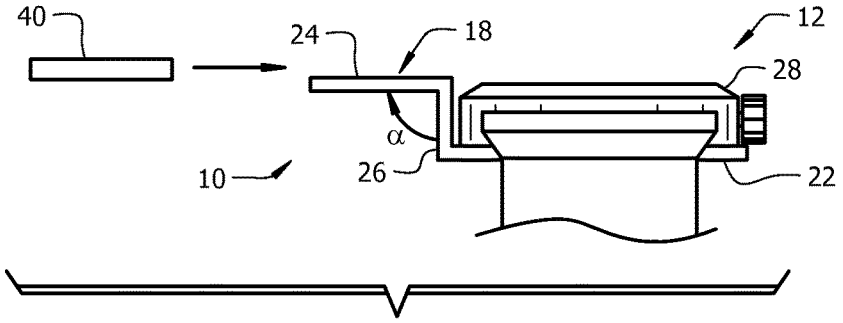
FIG. 5 is an end view (with watch band removed) of an exemplary embodiment of a sleeve keeper watch bracket and decorative cover in use with a wristwatch according to the teachings of the present disclosure.
Figure 9:
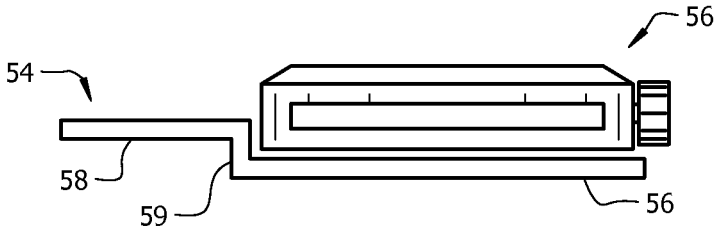
FIG. 9 is an end view (with watch band removed) of yet another exemplary embodiment of a sleeve keeper watch bracket in use with a wristwatch according to the teachings of the present disclosure.

The sleeve keeper watch bracket 10 includes a main member 22 with a generally planar surface, and a secondary member 24 also with a generally planar surface, where the main member 22 and secondary member 24 are securely linked or connected by a third member 26. As best seen in FIGS. 4 and 5, the main member 22 and secondary member 24 generally lie on two different but parallel planes, where the secondary member 24 is generally on a plane elevated above the plane of the main member 22. As seen in the end view in FIG. 5, the angle $\alpha$ between secondary member 24 and third member 26 is generally a right angle (90°), but it may be any angle less than 90° (an acute angle). In a preferred embodiment, third member 26 is at right angles to both main member 22 and secondary member 24. Preferably, the third member 26 extends a distance generally equal to the thickness of the wristwatch case 28, so that the secondary member 24 is generally co-planar with the face of the wristwatch. Alternatively, the secondary member 24 may be on a plane below the face of the wristwatch as shown in FIG. 9.

The sleeve keeper watch bracket 10 includes a main member 22 that is preferably identical or similar in shape and size with the case or back of the wristwatch 28. Accordingly, if the wristwatch case 28 is round in shape, then the main member 22 may have a rounded shape such as shown in FIGS. 1 and 4, and if the wristwatch case is square in shape, then the main member 32 may have a square shape such as shown in FIGS. 2 and 3. The length of the secondary member 24 and 34 is preferably such that the wearer's sleeve remained retained under the secondary member with the full range of arm motion, such as with the arm raised overhead and raised to the side, for example. The main member 22 and 32 may alternately form part of the watch case and be integral therewith, be detachably secured to the watch case (using, e.g., double-sided tape, hook-and-loop tape, etc.) or be permanently secured to the watch case (using, e.g., adhesives, bonding agents, two-part epoxy, etc.). The bracket may be constructed of a sturdy and rigid material such as metal, plastics, composites, etc. For example, the bracket may be constructed from a rectangular strip of metal bent to the desired shape.

Further shown in FIGS. 1-4 are lighting elements 18 and 20 disposed on secondary member 24 and 34, such as one or more LED (light emitting diodes) for lighting (flashlight) and/or decorative purposes. The lighting element may point in a direction away from the secondary member 24 and 34 or along an axis parallel with the plane of the secondary member 24 and 34. The lighting element may be powered by a small disc battery and turned on/off by a small hidden switch (not shown). Using the lighting element, the wearer may move his/her hand and wrist to aim the emitted light, which may be in one or more colors.

Figure 6:
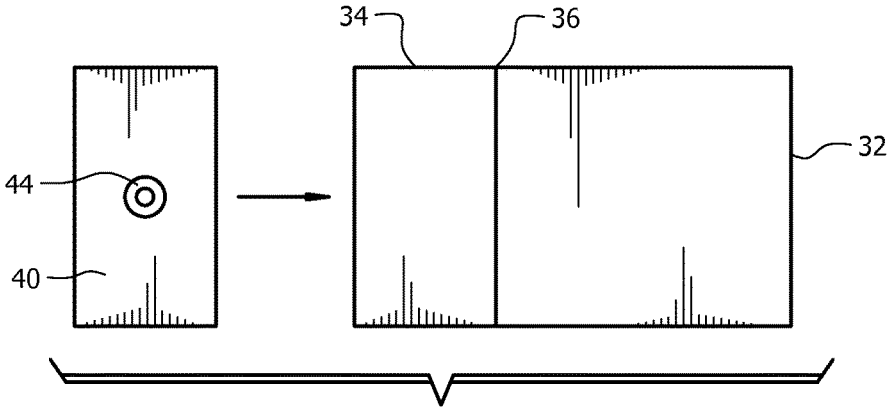
FIG. 6 is a top view of an exemplary embodiment of a sleeve keeper watch bracket and decorative cover according to the teachings of the present disclosure.
Figure 7:
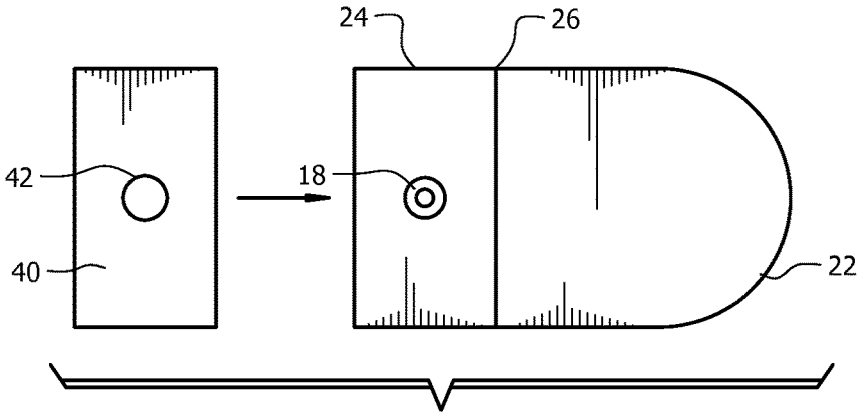
FIG. 7 is a top view (with watch band removed) of another exemplary embodiment of a sleeve keeper watch bracket and decorative cover according to the teachings of the present disclosure.

FIG. 5 is a an end view (with watch band removed for clarity) of an exemplary embodiment of a sleeve keeper watch bracket 10 and decorative cover 40 in use with a wristwatch 12 according to the teachings of the present disclosure. FIGS. 6 and 7 are top views of exemplary embodiments of a sleeve keeper watch bracket and decorative cover 40 according to the teachings of the present disclosure. The decorative cover 40 preferably fits snugly and securely (e.g., friction fit or using low-tack re-adherable adhesive) over the secondary member, and can be of a shade that is identical, close to, or complementary to the color of the garment sleeve. The decorative cover 40 may also complement the colors and tones found in the watch case and/or band. For example, if the watch band is of a dark brown leather, the decorative cover 40 may be constructed of the same material. The decorative cover 40 may additionally incorporate ornamental designs, beading, jewels, graphics, monograms, logos, fabrics, lights, and other decorative elements. Because the decorative cover 40 may be easily removed, the wearer may choose interchangeable designs and colors that hides or diminishes the visual impact of the bracket, or enhance and contribute to the wristwatch design. The decorative cover 40 may be constructed of plastic, rubber, fabric, leather, sued, metal, and/or a number of other suitable materials. In FIG. 7, an opening 42 is defined in the decorative cover 40 to allow the lighting element 18 on the secondary member 24 to emit its light. In FIG. 6, the cover 40 incorporates a lighting element 44 for decorative and/or functional purposes.

In these embodiments, the underside surface of the secondary member 24 and 34 that faces the garment sleeve may further incorporate a material that tends to engage, adhere, or stick to the sleeve. For example, using just the hook portion of the hook-and-loop tape on the underside surface may help to engage the garment sleeve and retain it under the bracket. Other suitable materials may be used. The material may be adhered or applied to the secondary member 24 and 34. Alternatively, the underside of decorative cover 40 may incorporate the tacky material to encourage the garment sleeve to be retained thereunder.

In alternate embodiments, the secondary member 24 and 34 may be hinged at its interface to the third member 26 and 36, and may even be spring-loaded to help push down and retain the sleeve underneath it toward the wearer's arm.

Yet in another alternate embodiment, the secondary member 24 and 34 may be generally identical or similar in shape and size as the watch face, so that in the closed state or position, the secondary member 24 and 34 may fold over the face of the wristwatch and act as a cover for the face of the wristwatch. Upon detection of the wearer's arm being raised in a substantially horizontal manner, as when the wearer desires to look at the wristwatch worn on the wrist, the secondary member 24 and 34 may automatically spring from the closed position to an open position, revealing the face of the wristwatch and holding back the garment sleeve at the same time. The secondary member 24 and 34 may incorporate ornamental designs on both surfaces to enhance the beauty of the wristwatch. A microprocessor, motion sensors, actuator, spring-loaded hinges, and latches may be used to achieve these functionalities.

Figure 8:
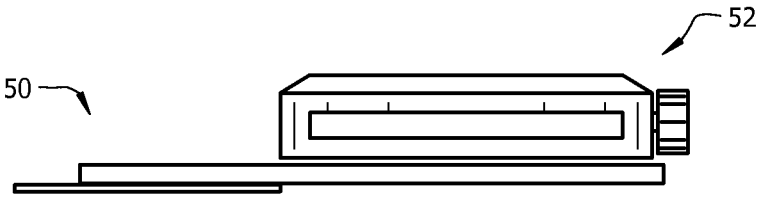
FIG. 8 is an end view (with watch band removed) of another exemplary embodiment of a sleeve keeper watch bracket in use with a wristwatch according to the teachings of the present disclosure.

FIG. 8 is an end view of another exemplary embodiment of a sleeve keeper watch bracket 50 in use with a wristwatch 52 according to the teachings of the present disclosure. This embodiment employs a watch bracket 50 that is a generally planar plate adhered or incorporated to the wristwatch case. The plate may be a rectangular flat metal plate that extends from under the wristwatch case toward the garment sleeve, and is operable to retain the sleeve underneath it. The extended member may incorporate a decorative cover, a spring-loaded retainer, and/or sleeve-retention material as set forth above. In this embodiment, the sleeve keeper watch bracket has a slimmer combined profile the embodiments shown in FIGS. 1-7 and is not as bulky.

FIG. 9 is an end view of yet another exemplary embodiment of a sleeve keeper watch bracket 54 in use with a wristwatch according to the teachings of the present disclosure. Its main member 56 is disposed below the wristwatch case or incorporated therein. The secondary member 58 also extends toward the garment sleeve and has the same functionality of retaining the garment sleeve. However, the third member 59 is substantially shorter, so that the secondary member 58 does not lie in the same plane as the watch face. The secondary member 58 lies in a plane below the plane of the watch face. In this embodiment, the sleeve keeper watch bracket 54 has a slimmer combined profile than the embodiments shown in FIGS. 1-7 and is not as bulky.

Figure 10:
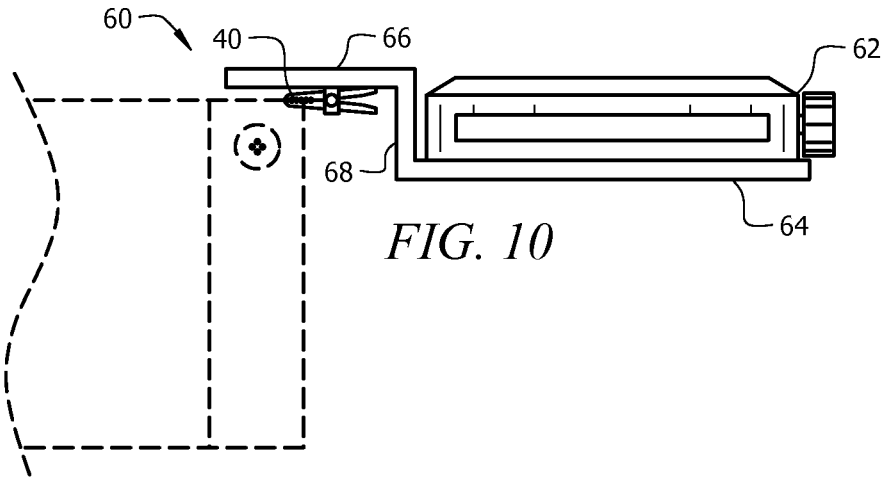
FIG. 10 is an end view (with watch band removed) of yet another exemplary embodiment of a sleeve keeper watch bracket in use with a wristwatch according to the teachings of the present disclosure.

FIG. 10 is an end view (with watch band removed) of yet another exemplary embodiment of a sleeve keeper watch bracket 60 in use with a wristwatch 62 according to the teachings of the present disclosure. In this embodiment, the main member 64 is connected to a secondary member 66 via a third member 68. Unlike using a tacky material as described above, the secondary member 66 of this embodiment incorporates a sleeve retention element in the form of a spring-loaded clip or clamp 70. In operation, the user clips the garment sleeve to the bracket with the clip 70 so that the sleeve is securely held back from the watch face.

Figure 11A:
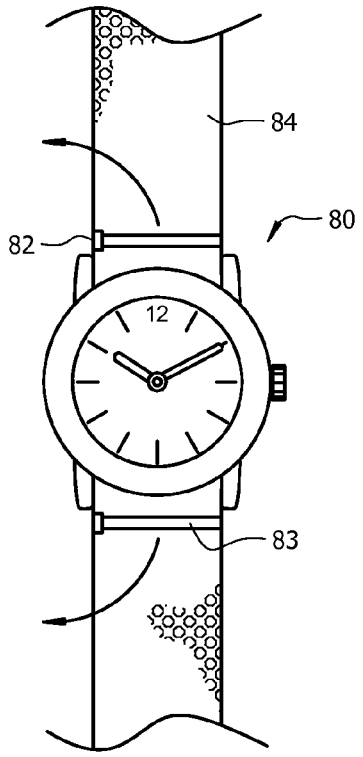
FIGS. 11A and 11B are top views of yet another exemplary embodiment of a sleeve keeper watch bracket in use with a wristwatch according to the teachings of the present disclosure.
Figure 11B:
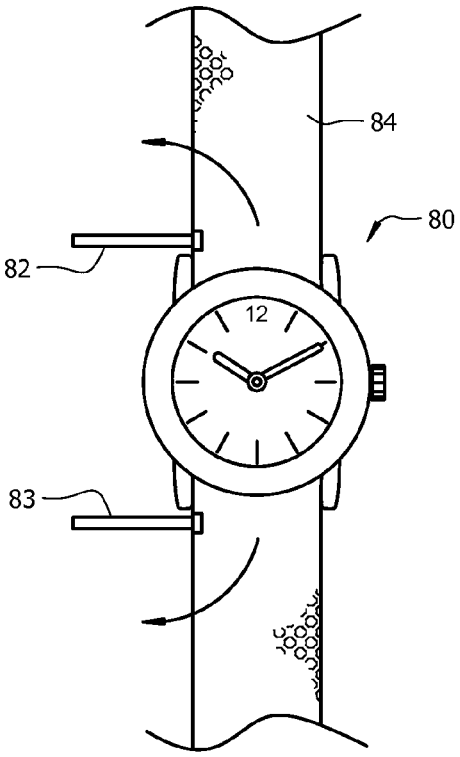

FIGS. 11A and 11B are top views of yet another exemplary embodiment of a sleeve keeper watch bracket 80 in use with a wristwatch according to the teachings of the present disclosure. In this embodiment, two spring-loaded members/fingers 82 and 83 are operable to go from a first closed state resting on the wristband 84, to swing or flip to an open state so that they protrude from the wristband 84 in substantially perpendicular relation thereto and hold back the garment sleeve. In this way, the garment sleeve is held back and the wristwatch can be easily seen without two-handed operations. A microprocessor, motion sensors, actuator, spring-loaded hinges, and latches may be used to achieve these functionalities.

Figure 12A:
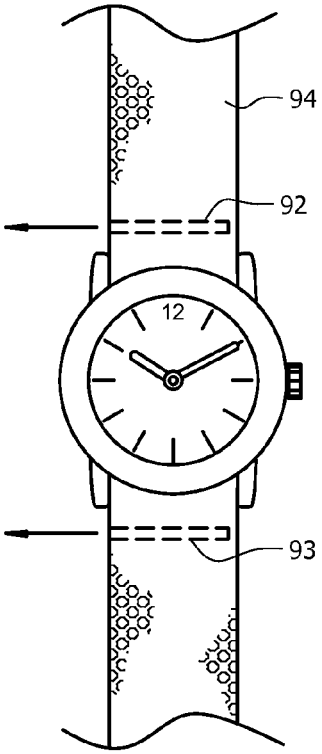
FIGS. 12A and 12B are top views of yet another exemplary embodiment of a sleeve keeper watch bracket in use with a wristwatch according to the teachings of the present disclosure.
Figure 12B:
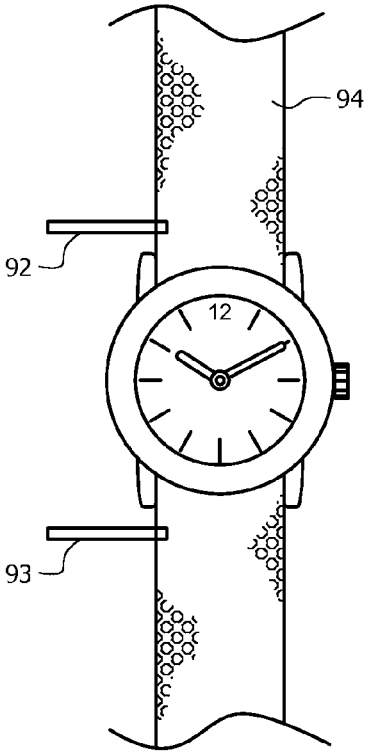

FIGS. 12A and 12B are top views of yet another exemplary embodiment of a sleeve keeper watch bracket 90 in use with a wristwatch according to the teachings of the present disclosure. In this embodiment, two members/fingers 92 and 93 may be hidden and stored inside the wristband 94. When the wearer desires to deploy the sleeve keeping function, the wearer can pull out or actuate the two members/fingers so that they protrude from the wristband 94 in substantially perpendicular relation thereto and hold back the garment sleeve. Alternatively, the two members may deploy automatically when sensing the wearer's arm motion that indicate a desire to view the timepiece.

The bracket described herein can be made to be part of a decorative bracelet, for example. The bracket is operable to keep the garment sleeve up to reveal the bracelet. Some garments may have sleeves that are too long and the wearer may desire to keep the sleeve back when performing certain activities. For example, the user may slip on two wrist bands equipped with the sleeve keeper brackets when the user is working on automotive repairs, painting, craft projects, cleaning, etc.

The features of the present invention which are believed to be novel are set forth below with particularity in the appended claims. However, modifications, variations, and changes to the exemplary embodiments described above will be apparent to those skilled in the art, and the sleeve keeper watch bracket described herein thus encompasses such modifications, variations, and changes and are not limited to the specific embodiments described herein.

What is claimed is:

1. A sleeve keeper watch bracket for use with a wristwatch worn by a user, comprising:

a first generally planar member having a shape and size generally corresponding to a case of the wristwatch, the first member generally lying in a first plane;

a second generally planar member generally lying in a second plane parallel to and above the first plane;

a third member coupling the first member and second member, the third member being substantially perpendicular to the first and second members, the orientation and configuration of the first, second, and third members being fixed; and wherein the first member is securely and directly affixed to an underside surface of the wristwatch case so that the second member extends significantly beyond the wristwatch case along an axis generally parallel to the user's arm, and away from the user's hand and is adapted to hold back from the wristwatch face a long sleeve of a garment worn by the user.

2. The sleeve keeper watch bracket of claim 1, wherein the first member is affixed to the wristwatch case by a component selected from the group consisting of: double-sided tape, hook-and-loop tape, low-tack re-adherable adhesive, two-part epoxy.

3. The sleeve keeper watch bracket of claim 1, wherein the first member is integrally formed as part of the wristwatch case.

4. The sleeve keeper watch bracket of claim 1, further comprising a decorative cover adapted to envelope the second member.

5. The sleeve keeper watch bracket of claim 1, wherein the second member is generally co-planar with a face of the wristwatch.

6. The sleeve keeper watch bracket of claim 1, wherein the second member is generally lying in a second plane generally below a face of the wristwatch.

7. The sleeve keeper watch bracket of claim 1, wherein the second member is generally lying in a second plane above the first plane.

8. The sleeve keeper watch bracket of claim 1, wherein the second member is generally lying in a second plane co-planar with the first plane.

9. The sleeve keeper watch bracket of claim 1, wherein the second member includes a retention material adapted to retain the garment sleeve.

10. The sleeve keeper watch bracket of claim 1, wherein the second member includes a clip adapted to retain the garment sleeve.

11. The sleeve keeper watch bracket of claim 1, further comprising a mechanism configured to deploy the second member from a closed position overlying the watch face to an open position extending toward the garment sleeve.

12. The sleeve keeper watch bracket of claim 1, wherein the second member further incorporates one of a lighting element, ornamental design, beading, jewels, monogram, and logo.

13. A sleeve keeper bracket for use with a wristwatch worn by a user, comprising:

a first elongated finger member coupled to a wrist band on a first side of the wristwatch having a watch face enclosed in a watch case, the watch case lying in a plane;

a second elongated finger member coupled to the wrist band on a second side of the wristwatch;

a deployment mechanism adapted to automatically deploy the first and second elongated finger members so as to extend both first and second elongated finger members, at an acute angle from the plane of the watch case, away from the user's hand in the same direction along an axis generally parallel to the user's arm and adapted to hold back from the wristwatch a long sleeve of a garment worn by the user.

* * * * *